US006089734A

United States Patent [19]

Yousefzadeh

[11] Patent Number: 6,089,734

[45] Date of Patent: Jul. 18, 2000

[54] TABLE LAMP WITH BASE-MOUNTED FINIAL RECEIVER

[76] Inventor: Kamran Yousefzadeh, 1727 S. Bentley Ave., #102, Los Angeles, Calif. 90025

[21] Appl. No.: 09/228,810

[22] Filed: Jan. 11, 1999

Related U.S. Application Data

[60] Continuation-in-part of application No. 09/050,826, Mar. 30, 1998, Pat. No. 5,857,652, which is a division of application No. 08/683,259, Jul. 18, 1996, Pat. No. 5,758,850.

[51] Int. Cl.[7] ..... F21S 6/00

[52] U.S. Cl. ..... 362/414; 362/124; 362/808; 428/16; 428/28

[58] Field of Search ..... 362/124, 410, 362/412, 414, 416, 417, 808; 428/16, 28

[56] References Cited

U.S. PATENT DOCUMENTS

| | | | |
|---|---|---|---|
| 1,811,723 | 6/1931 | Loewer | 362/124 |
| 2,302,556 | 11/1942 | Kriebel | 362/414 |
| 2,701,300 | 2/1955 | Rubin | 362/808 |
| 3,743,827 | 7/1973 | Holtvoigt | 362/124 |
| 4,318,159 | 3/1982 | Kaisner | 362/124 |
| 4,562,521 | 12/1985 | Noguchi | 362/414 |
| 4,736,278 | 4/1988 | Wolens et al. | 362/410 |

*Primary Examiner*—Alan Cariaso
*Attorney, Agent, or Firm*—Scot A. Reader

[57] ABSTRACT

A table lamp suitable for displaying a base-mounted finial has an adapter plate for supporting both a finial assembly and a pipe and wiring assembly using a single hole in the base. The adapter plate enables the pipe to be mounted outside the base perimeter while the hole is used for a finial assembly. The visual benefits of finials may thereby be extended to table lamp bases without defacing or modifying the visible surface of the base.

10 Claims, 3 Drawing Sheets

TABLE LAMP WITH BASE-MOUNTED FINIAL RECEIVER

This application is a continuation-in-part of application Ser. No. 09/050,826, filed Mar. 30, 1998, U.S. Pat. No. 5,857,652, which is a division of application Ser. No. 08/683,259, filed Jul. 18, 1996, issued as U.S. Pat. No. 5,758,850.

BACKGROUND OF THE INVENTION

The present invention relates to table lamps and, more particularly, to table lamps suitable for displaying decorative finials.

Finials are ornamental objects often used to beautify table lamps. Finials include a decorative portion, which varies in design, and may also include a mating portion having a threaded bore for coupling the finial with a finial receiver, also called a finial stud, of a table lamp. The decorative portion of finials is known to be designed and manufactured in many different sizes, shapes and styles, with each different design providing a unique visual appearance. In contrast, the mating portion of finials generally has a standard size bore adapted for coupling with standard size finial receivers, which typically have either size ¼"-27 or ⅛ IPS threading. Because of this standard sizing, the table lamp user is able to select a finial of a preferred size, shape and style from among a wide variety of ornamental designs.

It has long been known to use a finial to beautify the top of a table lamp. In that application, the threaded bore of the finial is typically coupled with the harp screw of the lamp to secure a center ring of a lamp shade therebetween. Once coupled, the decorative portion of the finial remains above the lamp shade, creating an aesthetically pleasing visual impression. The finial thus helps secure the lamp shade to the lamp base while at the same time beautifying the top of the lamp.

While finials are well-known from the above-described application, they have not been widely used to beautify table lamp bases. A primary reason for this is the absence on most bases of a finial receiver. Table lamp bases are often manufactured with a single hole through the center of the base reserved for the electrical wiring for the table lamp. To wit, wiring is run through the hole and through a pipe mounted on the hole and is coupled at the top of the pipe to electrical elements of a lighting assembly. A lamp shade is mounted on the lighting assembly to complete the table lamp assembly. Because the only hole in the base is used to accommodate the pipe and wiring assembly, it is precluded from being used alternatively to accommodate a finial assembly.

While it is possible to support a finial assembly elsewhere on the base, this would require defacing or modifying the visible surface of the base, such as by drilling another hole or gluing a finial receiver to the base.

Therefore, there is a general need for a table lamp which extends the visual benefits of finials to a table lamp base without defacing or modifying the visible surface of the base.

SUMMARY OF THE INVENTION

In its most basic feature, the present invention provides a table lamp in which a single hole through the table lamp base is relied on to support both a finial assembly and a pipe and wiring assembly. The present invention is implemented with the expedient of an adapter plate. Within the base perimeter, the adapter plate is coupled with a finial receiver projecting upward through the hole. Outside the base perimeter, the adapter plate is coupled with a pipe and wiring assembly extending upward above the base. The pipe may extend within the base perimeter after traversing an appropriate distance along its upward trajectory such that the lighting assembly is disposed within the base perimeter without interfering with the finial assembly. A mounting screw may be used to prevent the adapter plate from rotating about the finial receiver axis. A finial may be mounted to the finial receiver to extend the visual benefits of finials to the table lamp base without defacing or modifying the visible surface of the base.

These and other features and advantages of the present invention will become apparent from consideration of the drawings which are briefly described below and the detailed description of the preferred embodiment. Of course, the actual scope of the invention is defined by the appended claims.

DETAILED DESCRIPTION OF THE PREFERRED EMBODIMENT

Figure 1:
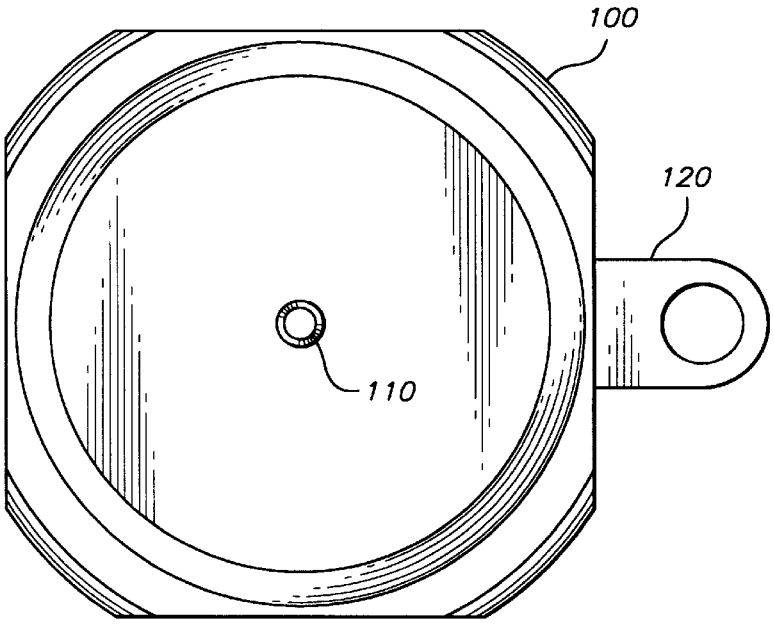
FIG. 1 is a top view of a table lamp base coupled with a finial receiver and adapter plate.
Figure 2:
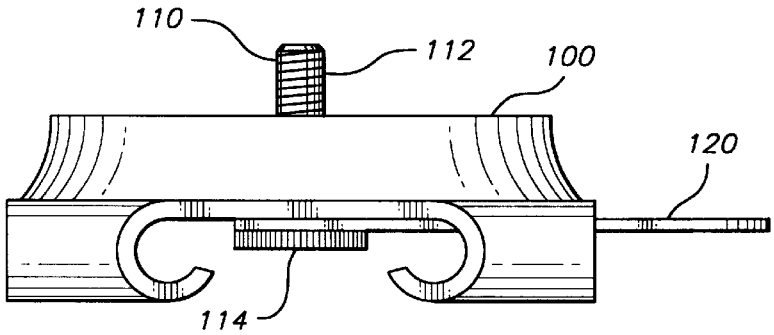
FIG. 2 is a side view of the coupled table lamp base of FIG. 1.
Figure 3:
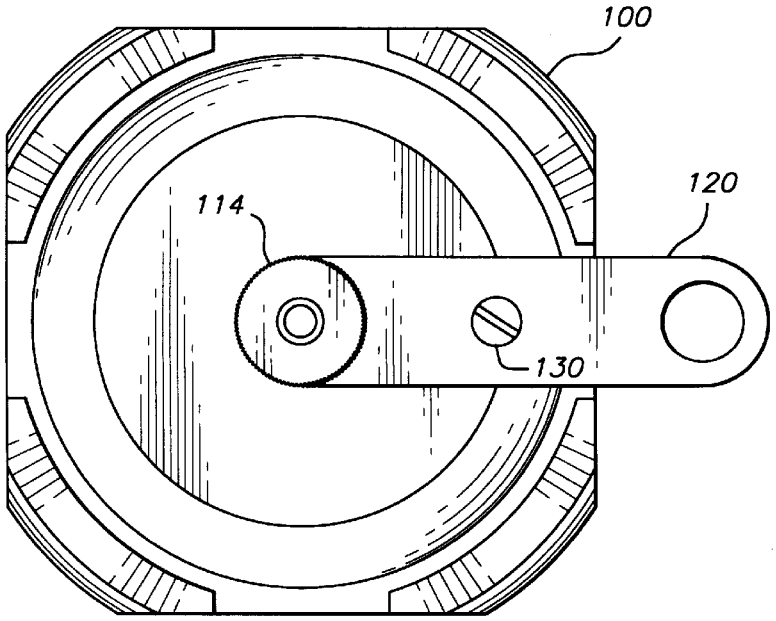
FIG. 3 is a bottom view of the coupled table lamp base of FIG. 1.

In FIGS. 1 through 3 a table lamp base 100 coupled with a finial receiver 110 and adapter plate 120 is shown in various views. Finial receiver 110 includes a threaded portion 112 and a knob 114. Threaded portion 112 projects upward through a hole in base 100 and is rigidly retained in base 110. Threaded portion 112 and knob 114 may be physically distinct subcomponents or may alternatively be a single integrally formed component. Threaded portion 112 preferably is of thread size ¼"-27 or another size fashioned to receive standard-sized finials. Plate 120 is coupled with receiver 110 between the bottom surface of base 100 and knob 114. Plate 120 extends outward radially from receiver 110 such that a hole near the end of plate 120 opposite receiver 110 is outside of the perimeter of base 100. Mounting screw 130 extends through a central hole in plate 120 and into the bottom surface of base 100 to prevent rotation of plate 120 about receiver 110. Plate 120 is preferably made of a rigid material, such as metal.

Figure 4:
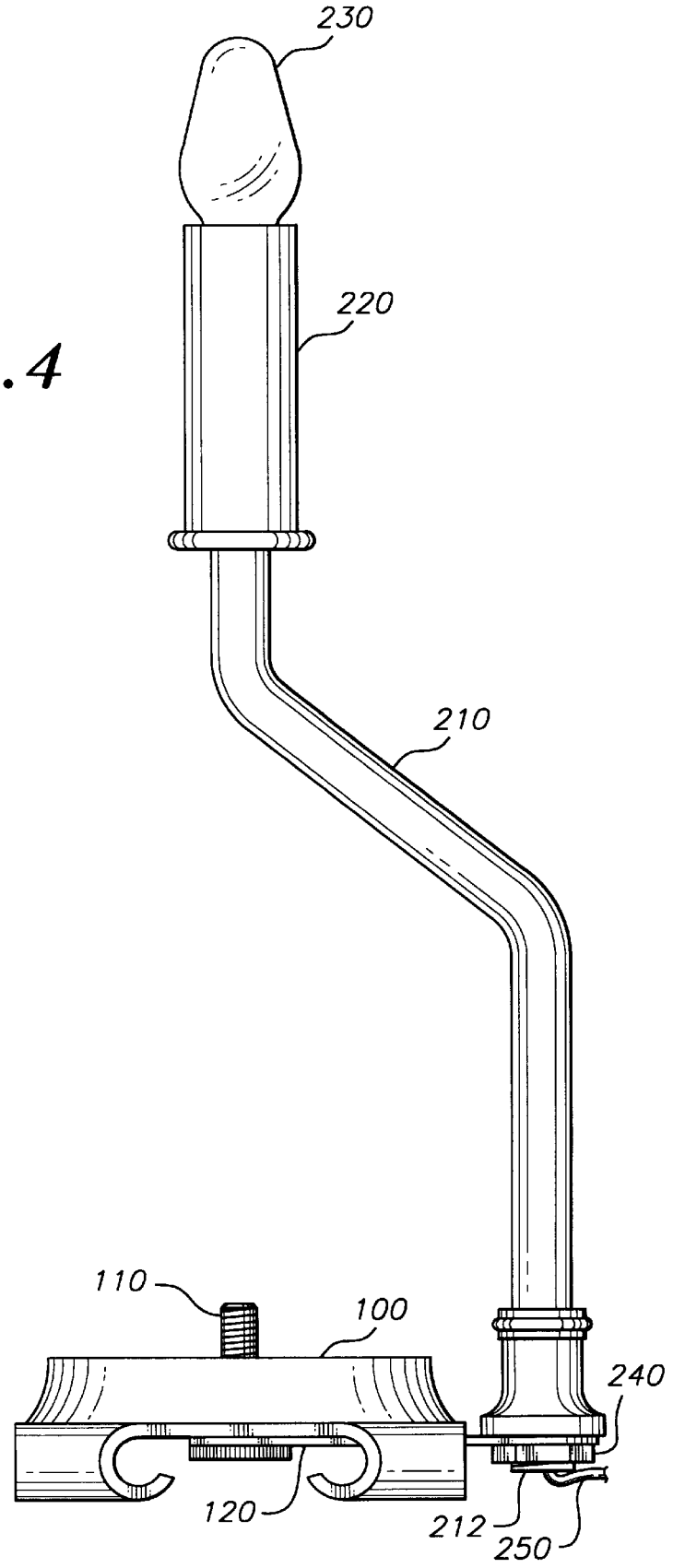
FIG. 4 is a side view of the coupled table lamp base of FIG. 1 further coupled with a pipe and wiring assembly and a lighting assembly.

Referring to FIG. 4, a side view of the coupled table lamp base of FIG. 1 further coupled with a pipe and wiring assembly and lighting assembly is shown. Pipe 210 has an externally threaded portion 210 projecting downward through the hole at the end of adapter plate 120 which is clear of base 100. Pipe 210 is securely mounted to plate 120 by screwing mounting nut 240 on externally threaded portion 210. Pipe 210 has a bend inclined toward the center of base 100 along at least part of its upward trajectory such that the lighting assembly, including socket 220 and bulb 230, is generally centered above base 100. The inward bend in pipe 210 is preferably arranged to begin at an advanced point along its upward length such that pipe 210 does not interfere with the mounting or display of a finial on finial receiver

110. Pipe 210 is hollow such that wiring 250 runs through the entire length of pipe 210 into lamp socket 220. Socket 220 has electrical elements for coupling with wiring in a manner well known to the art. Bulb 230 is screwed into socket 220.

Figure 5:
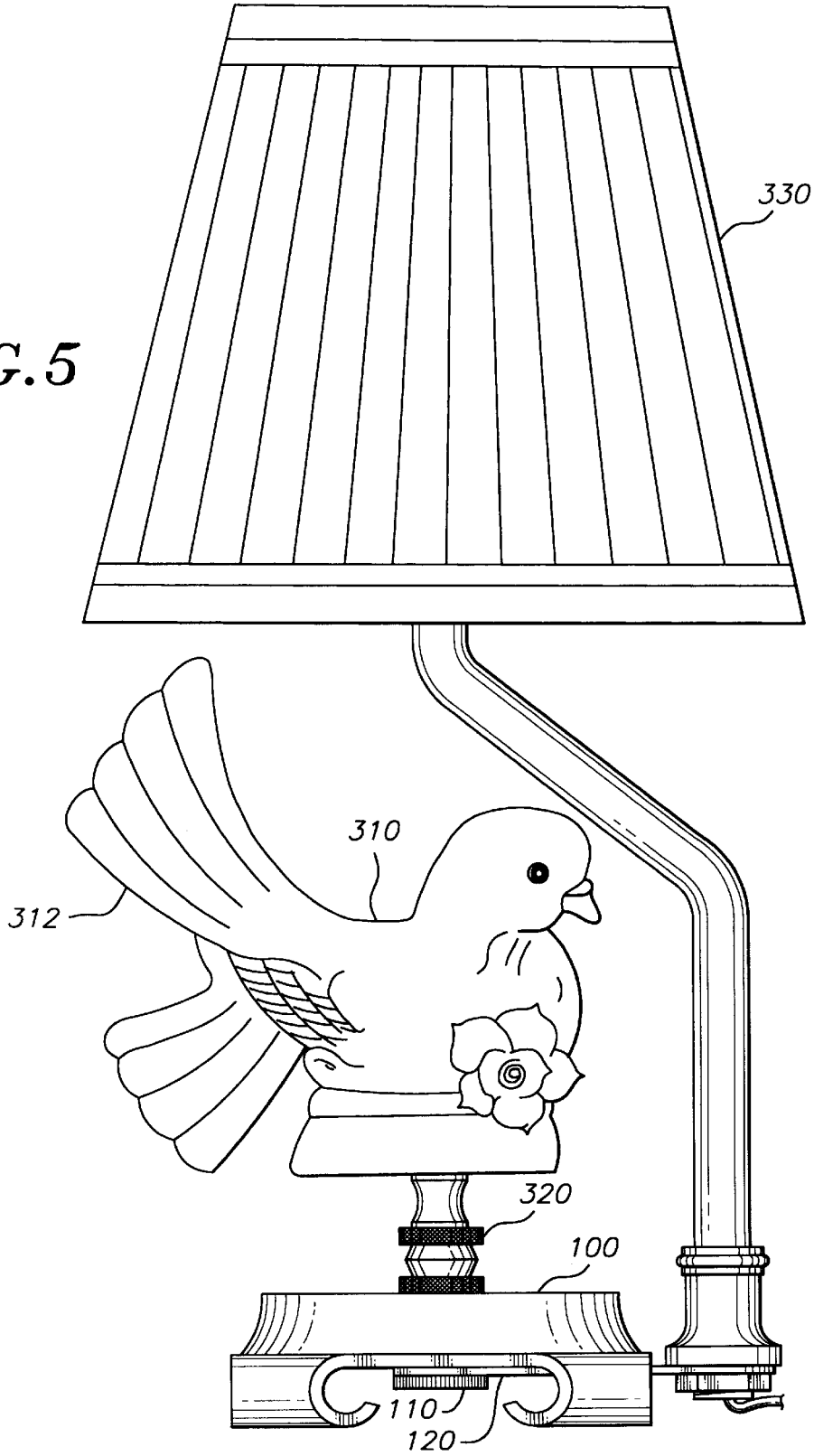
FIG. 5 is a side view of a fully assembled table lamp.

Turning now to FIG. 5, a fully assembled table lamp is shown. Finial 310 has a decorative portion 312 and a mating portion 320. Mating portion 320 is mounted on receiver 110 by screwing mounting portion 320 on threaded portion 112. Lamp shade 330 is mounted on lighting assembly in a manner well known to the art.

It will be appreciated that a table lamp has been described which allows an interchangeable finial to be displayed on a table lamp base centrally and without the need to deface or modify the visible surface of the base. This arrangement has numerous advantages, including (i) the aesthetic benefits of a centrally-mounted base finial; (ii) finial interchangeability (by replacing the finial with another); and (iii) lamp style interchangeability (by removing the finial receiver and substituting a conventional pipe for the bent pipe).

It will also be appreciated by those of ordinary skill in the art that the invention can be embodied in other specific forms without departing from the spirit or essential character hereof. The present description is therefore considered in all respects to be illustrative and not restrictive. The scope of the invention is indicated by the appended claims, and all changes that come within the meaning and range of equivalents thereof are intended to be embraced therein.

I claim:

1. A table lamp for displaying a base-mounted finial, comprising, a base having a hole;

a finial receiver projecting upward through the hole;

an adapter plate coupled with the finial receiver and extending outward beyond the base perimeter;

a pipe coupled with adapter plate beyond the base perimeter and extending upward;

a lighting assembly coupled with the pipe; and a wire extending upward through the pipe and coupled with the lighting assembly.

2. The table lamp according to claim 1, wherein the adapter plate is coupled with the finial receiver below the base.

3. The table lamp according to claim 1, wherein the hole is centrally located within the base perimeter.

4. The table lamp according to claim 1, further comprising a finial coupled with the finial receiver.

5. The table lamp according to claim 1, wherein the pipe extends upward and inward to within the base perimeter.

6. The table lamp according to claim 1, wherein the pipe has an inward bend a substantial distance above the base.

7. The table lamp according to claim 6, wherein the inward bend ends a substantial distance below the lighting assembly.

8. The table lamp according to claim 1, wherein the adapter plate is rigid.

9. The table lamp according to claim 1, wherein the finial receiver has ¼"-27 threading.

10. The table lamp according to claim 1, wherein the finial receiver has ⅛ IPS threading.

* * * * *